US010155353B2

(12) United States Patent
Capoia

(10) Patent No.: US 10,155,353 B2
(45) Date of Patent: Dec. 18, 2018

(54) GLUING MACHINE FOR MAKING BOXES

(71) Applicant: PANOTEC S.R.L., Cimadolmo (IT)

(72) Inventor: Giuseppe Capoia, Cimadolmo (IT)

(73) Assignee: Panotec S.r.l., Cimadolmo (IT)

( * ) Notice: Subject to any disclaimer, the term of this patent is extended or adjusted under 35 U.S.C. 154(b) by 11 days.

(21) Appl. No.: 15/310,544

(22) PCT Filed: May 29, 2015

(86) PCT No.: PCT/IB2015/054047
§ 371 (c)(1),
(2) Date: Nov. 11, 2016

(87) PCT Pub. No.: WO2015/181780
PCT Pub. Date: Dec. 3, 2015

(65) Prior Publication Data

US 2017/0080665 A1 Mar. 23, 2017

(30) Foreign Application Priority Data

May 30, 2014 (IT) ..... UD2014A0091

(51) Int. Cl.

| | |
|---|---|
| ***B31B 50/00*** | (2017.01) |
| ***B31B 50/62*** | (2017.01) |
| ***B31B 50/64*** | (2017.01) |
| ***B31B 100/00*** | (2017.01) |
| ***B31B 110/35*** | (2017.01) |
| ***B31B 120/30*** | (2017.01) |

(52) U.S. Cl.
CPC ..... *B31B 50/62* (2017.08); *B31B 50/00* (2017.08); *B31B 50/006* (2017.08); *B31B 50/624* (2017.08); *B31B 50/64* (2017.08); *B31B 2100/00* (2017.08); *B31B 2110/35* (2017.08); *B31B 2120/30* (2017.08)

(58) Field of Classification Search
CPC ..... B31B 1/62; B31B 1/00; B31B 2203/066; B31B 2201/95; B31B 2201/6017; B31B 2203/003; B31B 2201/6026
See application file for complete search history.

(56) References Cited

U.S. PATENT DOCUMENTS

2005/0250635 A1* 11/2005 Diehr ..... B31B 1/00 493/79
2006/0081727 A1 4/2006 Stepaniak et al.
2012/0129670 A1 5/2012 Pettersson et al.

* cited by examiner

*Primary Examiner* — Michael N Orlando
*Assistant Examiner* — Joshel Rivera
(74) *Attorney, Agent, or Firm* — Themis Law

(57) ABSTRACT

A gluing machine and corresponding method of making a box starting from a pre-cut sheet, and of gluing the two edges of the box together. The gluing machine includes a fixed frame having at least a first support plane to support the pre-cut sheet, a first reference member to align the pre-cut sheet laterally with respect to the first support plane, and a gluing device to spread a gluing material on a fin of the pre-cut sheet, or on one lateral wall of the pre-cut sheet in correspondence to the fin. The gluing device and the first reference member are supported by the same support member mounted on the fixed frame and mobile with respect to the fixed frame between an inactive position and an operating position.

11 Claims, 8 Drawing Sheets

GLUING MACHINE FOR MAKING BOXES

FIELD OF THE INVENTION

Forms of embodiment described here concern a gluing machine for making boxes. In particular, the gluing machine is able to automatically glue together two edges of a sheet of relatively rigid material, such as for example paper, cardboard, plastic material or other, in order to make a box, for example, but not only, of the type known as "American box".

BACKGROUND OF THE INVENTION

In the industrial sector of the production of boxes, using a relatively rigid material, such as for example paper, cardboard, plastic material or other, it is known to cut, from a continuous strip of the pre-chosen material, a flat sheet, the development of which comprises all the walls of the box.

In particular, these so-called "American" boxes, are parallelepiped shaped consisting of six walls, that is, four lateral walls, a lower wall or bottom, and an upper wall or lid. To join together the end edges of the sheet and thus define the internal cavity of the box, the sheet is also provided with a fin, that persons of skill call "K element"; the fin protrudes from a lateral wall and is destined to be glued in correspondence to the edge of an adjacent lateral wall.

Gluing machines are known that glue the fin to the adjacent lateral wall. However, these known gluing machines all have the disadvantage that they require manual alignment and adjustment to the thickness of the pre-cut sheet by the operator, using a reference member that is positioned distant from the gluing unit, so that the gluing of the two parts is not always correct and precise.

Documents US-A-2006/081727 and US-A-2012/129670 describe gluing machines of the known type.

There is therefore a need to perfect a gluing machine to make boxes that can overcome at least one of the disadvantages of the state of the art.

In particular, one purpose of the present invention is to make a gluing machine to make boxes, that is completely automatic, that executes to perfection the gluing of the parts to be glued to each other and that, at the same time, does not require any operation by an operator other than to insert the pre-cut sheet on a support plane of the machine itself.

Another purpose of the present invention is to perfect a method that allows a gluing machine for making boxes to carry out the gluing of the two parts to be glued of the pre-cut sheet in a completely automatic way and in total safety.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the present invention or variants to the main inventive idea.

In accordance with the above purposes, forms of embodiment described here concern a gluing machine for making boxes, starting from a pre-cut sheet, the development of which comprises both at least the lateral walls of the box to be made, and also a joining fin between two of the lateral walls that are adjacent to each other. According to one form of embodiment, the gluing machine comprises a fixed frame having at least a first support plane to support the pre-cut sheet, a first reference member to align the pre-cut sheet laterally with respect to the first support plane, and a gluing device to spread a gluing material on the fin, or on one of the lateral walls in correspondence therewith.

In accordance with this form of embodiment, the gluing device and the first reference member are supported by the same support member mounted on the fixed frame and mobile with respect to the latter between an inactive position and an operating position.

With this new and inventive characteristic, the gluing machine for making boxes according to the present invention has the advantage that it can align easily and with precision the pre-cut sheet in correspondence with the gluing device.

In accordance with some forms of embodiment, a feed roll is mounted on the fixed frame and is rotatable around its own longitudinal axis, parallel to the first support plane.

In accordance with other forms of embodiment, moreover, the gluing device and the first reference member are disposed in an intermediate zone between two sides of the fixed frame and are aligned along a transverse axis perpendicular to the longitudinal axis.

In accordance with some forms of embodiment, a presser roll is mounted rotatable on the support member, parallel to the feed roll.

In accordance with other forms of embodiment, in the inactive position of the support member, the presser roll is distanced from the feed roll to allow the free passage of the pre-cut sheet between the two rolls, and in the operating position of the support member the presser roll is configured to press the pre-cut sheet against the feed roll.

In accordance with another form of embodiment, a drive member is provided to selectively make the feed roll rotate, whereas the presser roll is made to rotate by the feed roll, by means of a coupling that guarantees the connection between the feed roll and the presser roll in any position whatsoever of the support member.

In accordance with another form of embodiment, the first reference member comprises a vertical wall, having a lateral surface, which functions as a reference element, and a support element, consisting for example of a platen inclined downward with respect to the support plane, and configured to hold temporarily raised the lateral wall of the pre-cut sheet to be glued to the fin.

In accordance with another form of embodiment, a second reference member is provided in correspondence with the first reference member, to align the pre-cut sheet frontally with respect to the first support plane. Advantageously the second reference member comprises a vertical barrier selectively mobile between a first raised position, which interferes with the passage of the pre-cut sheet from the first support plane toward the gluing device, and a lowered position, which allows the free passage of the pre-cut sheet from the first support plane toward the gluing device.

Other forms of embodiment described here concern a gluing method for making a box by means of a gluing machine and starting from a pre-cut sheet. According to one form of embodiment, the method comprises at least a preparation step in which a gluing device and a first reference member are installed on the same support member mounted on a fixed frame of the gluing machine and mobile with respect to the latter between an inactive position and an operating position. Moreover, in some forms of embodiment, a feed roll is mounted rotatable on the fixed frame around its own longitudinal axis parallel to the first support plane, and furthermore a presser roll is mounted rotating on the support member parallel to the feed roll.

The method also comprises at least a first working step in which the pre-cut sheet to be glued is positioned on the first support plane, so that a first and a second lateral wall thereof are rested on the first support plane, a third lateral wall is folded above the second lateral wall, and a fourth lateral wall is folded with respect to the second lateral wall but rests on the first reference member so that a fin to be glued to the fourth lateral wall is positioned under the first reference member and is aligned with the gluing device.

In accordance with another form of embodiment, the gluing method also comprises at least a second working step in which the pre-cut sheet is thrust forward until an edge thereof, perpendicular to the fin, is taken into contact with a pair of sensors disposed one on one side and one on the other side with respect to the first reference member, the actuation of both the sensors causing the subsequent working steps to start, that is, the automatic gluing of the fin to the fourth lateral wall of the pre-cut sheet, under the programmed control of a central control unit.

The various aspects and characteristics described in the present description can be applied individually where possible. These individual aspects, for example aspects and characteristics described in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE DRAWINGS

These and other characteristics of the present invention will become apparent from the following description of some forms of embodiment, given as a non-restrictive example with reference to the attached drawings wherein.

Figure 1:
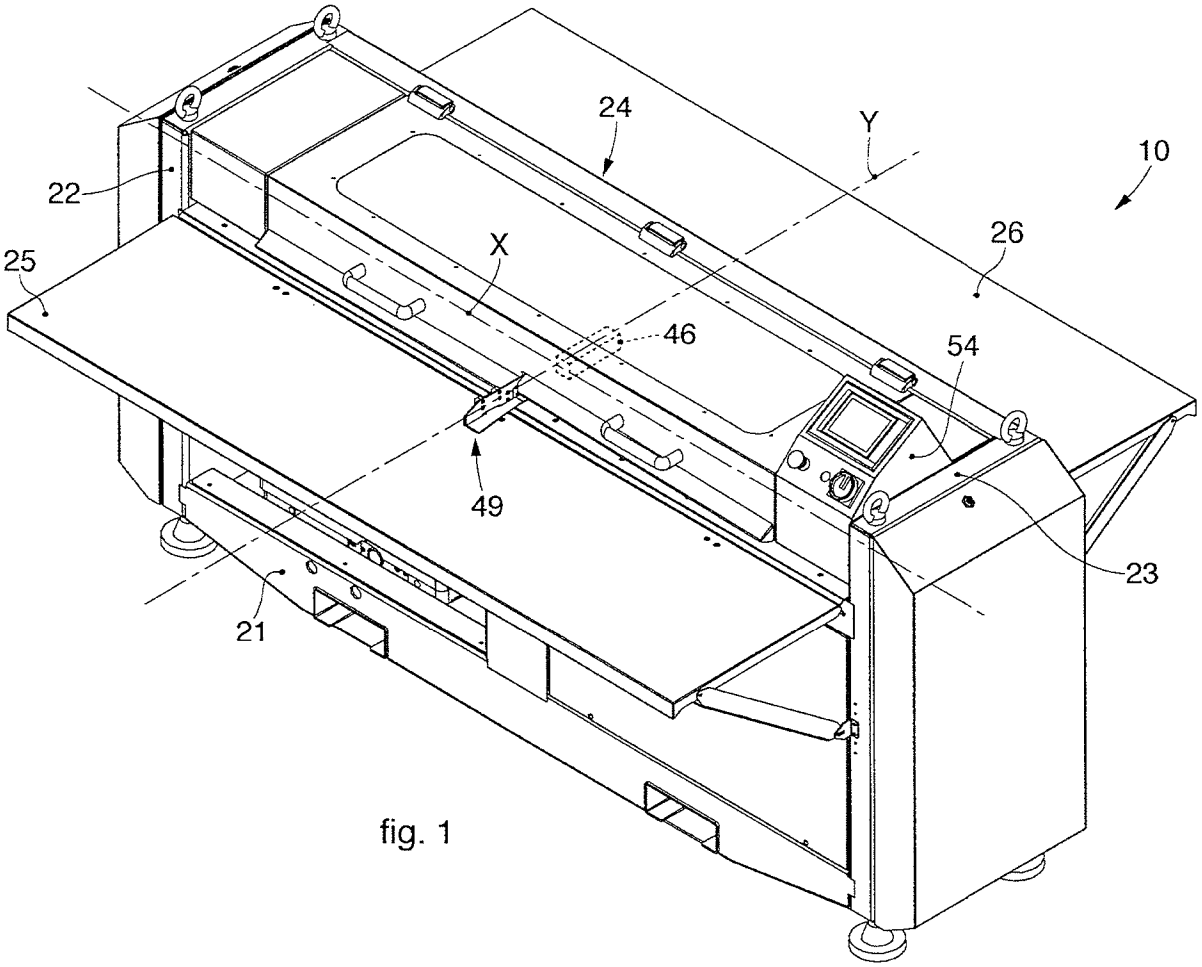
FIG. 1 is a three-dimensional view of a gluing machine for making boxes according to the present invention, in an inactive position.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF SOME FORMS OF EMBODIMENT

We shall now refer in detail to the various forms of embodiment of the present invention, of which one or more examples are shown in the attached drawings. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

Before describing these forms of embodiment, we must also clarify that the present description is not limited in its application to details of the construction and disposition of the components as described in the following description using the attached drawings. The present description can provide other forms of embodiment and can be obtained or executed in various other ways. We must also clarify that the phraseology and terminology used here is for the purposes of description only, and cannot be considered as limitative.

Figure 2:
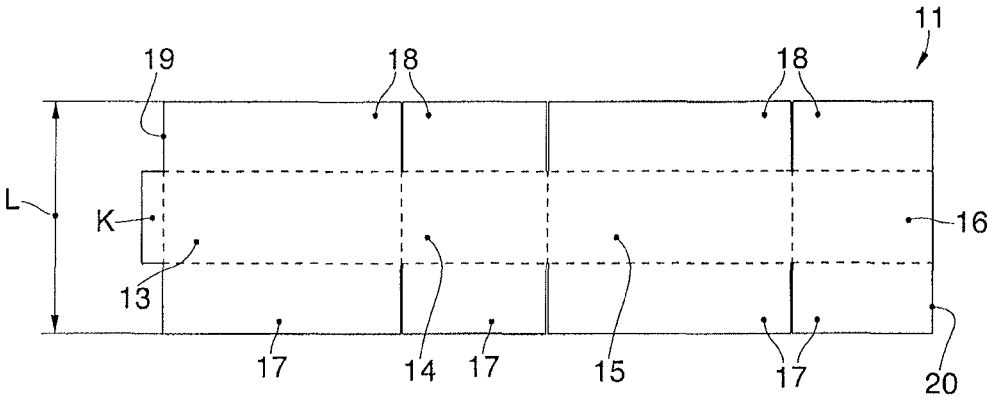
FIG. 2 is a plan view of a pre-cut sheet, which constitutes the development of a box to be made with the gluing machine of FIG. 1.
Figure 3:
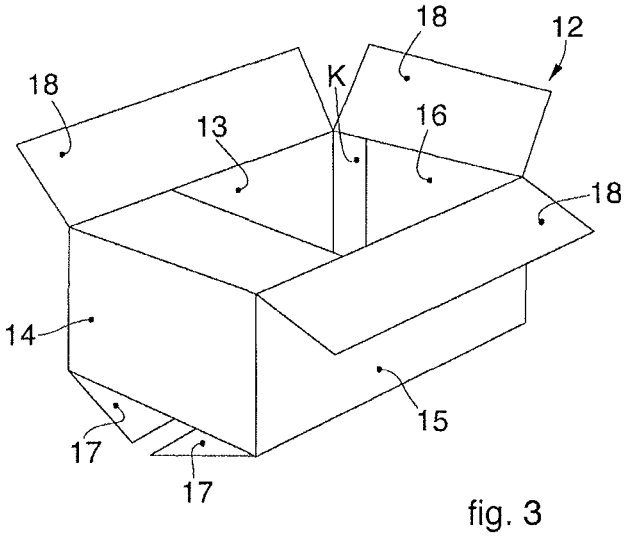
FIG. 3 is a three-dimensional view of a box produced by the gluing machine in FIG. 1, using the pre-cut sheet of FIG. 2.
Figure 4:
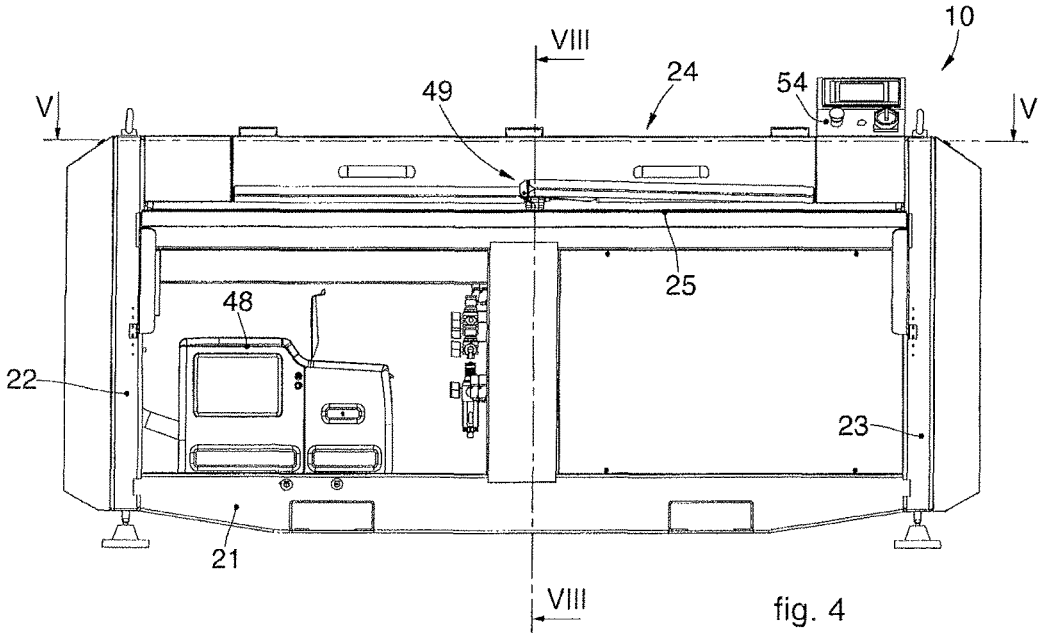
FIG. 4 is a front view of the gluing machine of FIG. 1.
Figure 5:
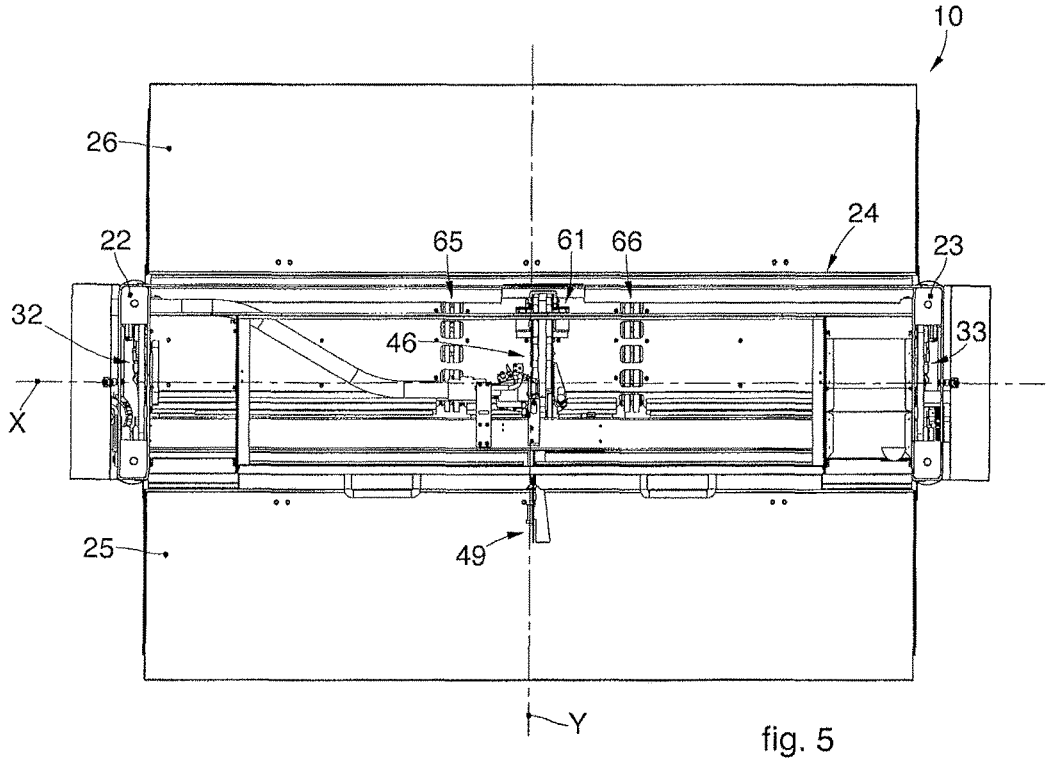
FIG. 5 is a section along the line V-V of FIG. 4.
Figure 6:
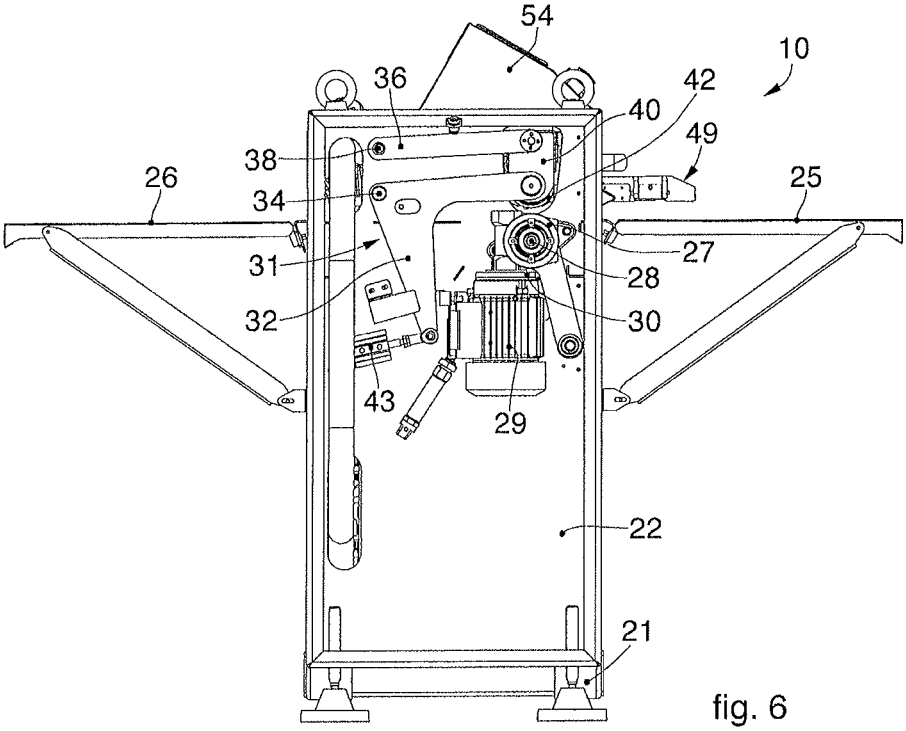
FIG. 6 is a left lateral view of the gluing machine of FIG. 1.
Figure 7:
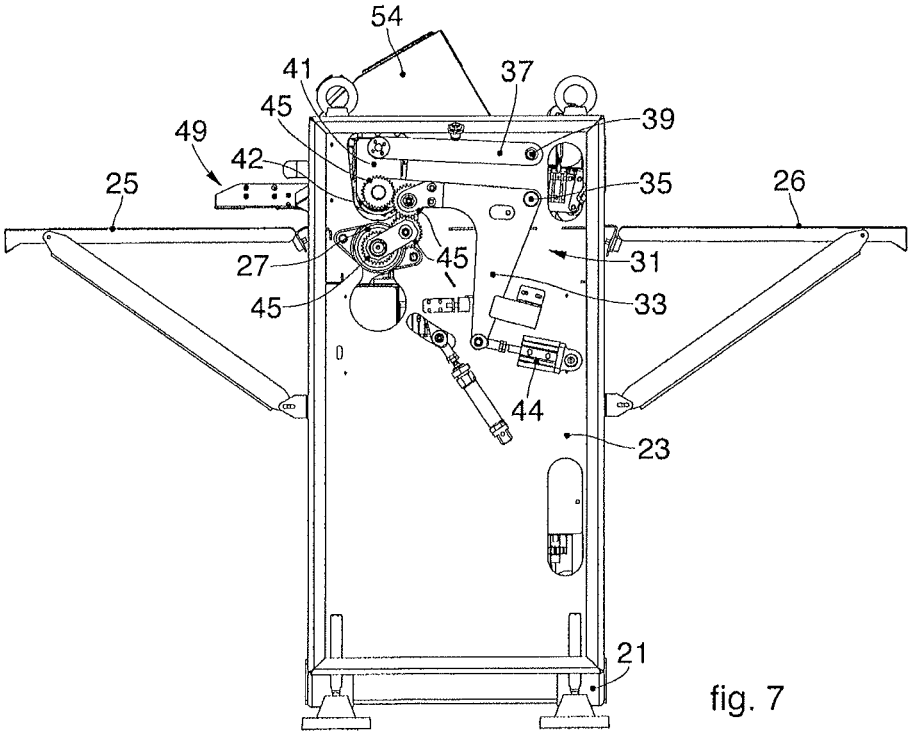
FIG. 7 is a right lateral view of the gluing machine of FIG. 1.
Figure 8:
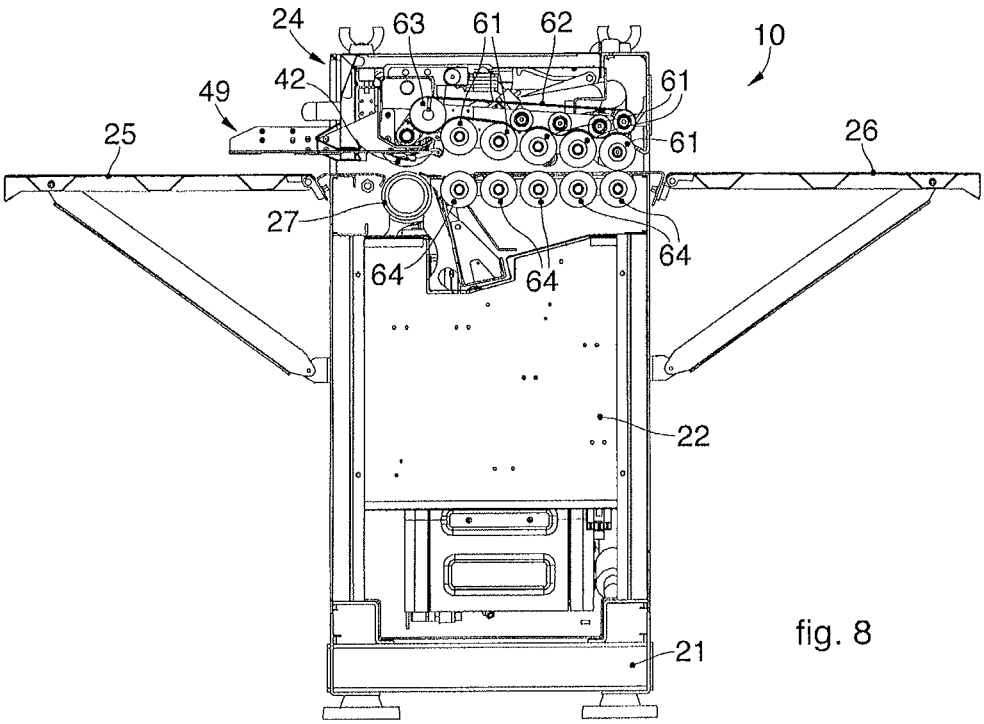
FIG. 8 is a section along the line VIII-VIII of FIG. 4.
Figure 9:
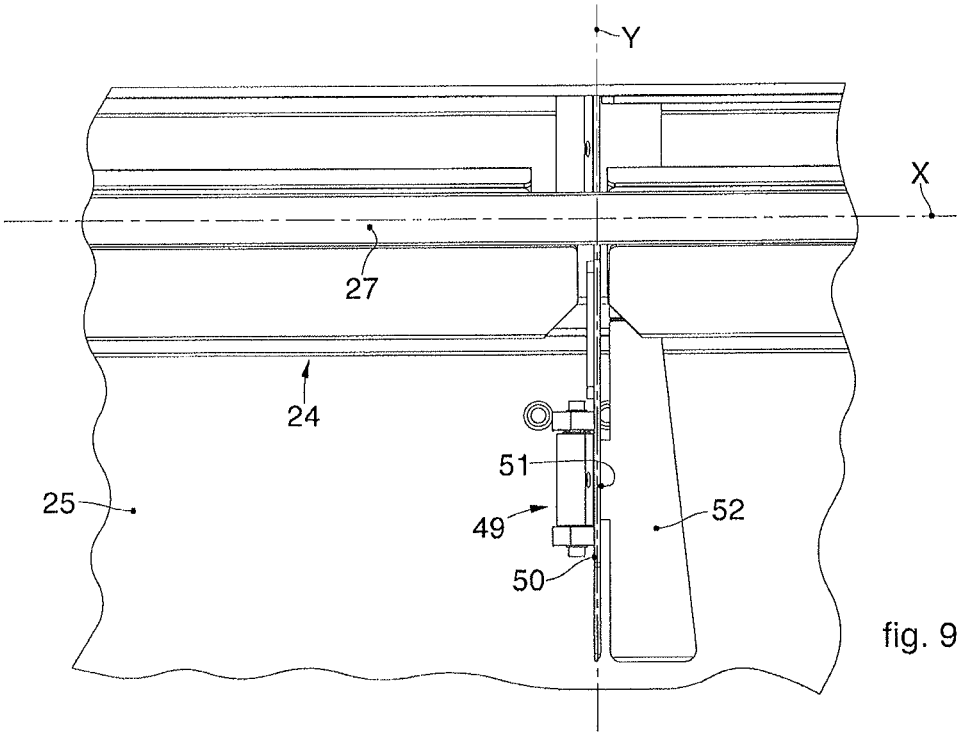
FIG. 9 is an enlarged detail of FIG. 5.

FIG. 1 is used to describe forms of embodiment of a gluing machine 10 in accordance with the present description, which is suitable to glue two parts together of a pre-cut sheet 11 (FIG. 2) of a sufficiently rigid material, such as for example paper, cardboard or plastic material, in order to make a box 12 (FIG. 3). By way of example, the box 12 can be of the known type such as an "American box", that is, parallelepiped shaped that comprises four lateral walls 13, 14, 15 and 16, four lower fins 17 configured to form the lower wall, or bottom of the box, and four upper fins 18 configured to form the upper wall, or lid of the box. The sheet 11 also comprises a fin K, adjacent to the external edge 19 of the wall 13, which is suitable to be glued to the internal surface of the wall 16, in correspondence to the edge 20 of the latter.

The sheet 11 can have, for example, an overall length L (FIG. 2) comprised between 250 mm and 3,000 mm and a thickness comprised between 1 mm and 8 mm.

The gluing machine 10 is suitable to glue the fin K completely automatically to the internal surface of the wall 16, in correspondence to the edge 20.

The gluing machine 10 (FIGS. 1 and 4 to 10) comprises a base or fixed frame 21 that laterally has two vertical sides 22 and 23 that support an operating unit 24, disposed horizontally, which will be described in more detail hereafter.

A first support plane 25 is disposed in front of the operating unit 24 and a second support plane 26 is disposed behind the operating unit 24. The two support planes 25 and 26 are coplanar with respect to each other and horizontal. Each of the two support planes 25 and 26 has, for example, a width of about 2,000 mm and a depth of about 500 mm.

The operating unit 24 comprises, in the lower part, a feed roll 27 (FIG. 6) with a longitudinal axis X parallel to the support planes 25 and 26, and pivoted on a pin 28 supported by the vertical sides 22 and 23 of the fixed frame 21.

The feed roll 27 is tangent to the horizontal plane on which the surfaces of the two support planes 25 and 26 lie, and is made to rotate by an electric motor 29, by means of a reduction unit 30 of the known type.

The operating unit 24 also comprises in the upper part, a support member, or mobile frame 31, pivoted on vertical sides 22 and 23 of the fixed plane 21. In particular, the mobile frame 31 comprises two L-shaped levers 32 and 33 (FIGS. 4, 6 and 7), disposed parallel to each other externally to the vertical sides 22 and 23 and pivoted on two fixed pins 34 and 35 (FIGS. 6 and 7) coaxial to each other.

The mobile frame 31 also comprises two connection arms 36 and 37, parallel to each other and pivoted on two fixed pins 38 and 39 coaxial to each other.

The two connection arms 36 and 37 are parallel to the two corresponding horizontal arms of the levers 32 and 33 and support, with these, two support plates 40 and 41, parallel to each other, on which a presser roll 42 is mounted rotatable, divided into two contiguous segments substantially coaxial to each other. The two levers 32 and 33 and the two connection arms 36 and 37 thus form a parallelogram.

Figure 11:
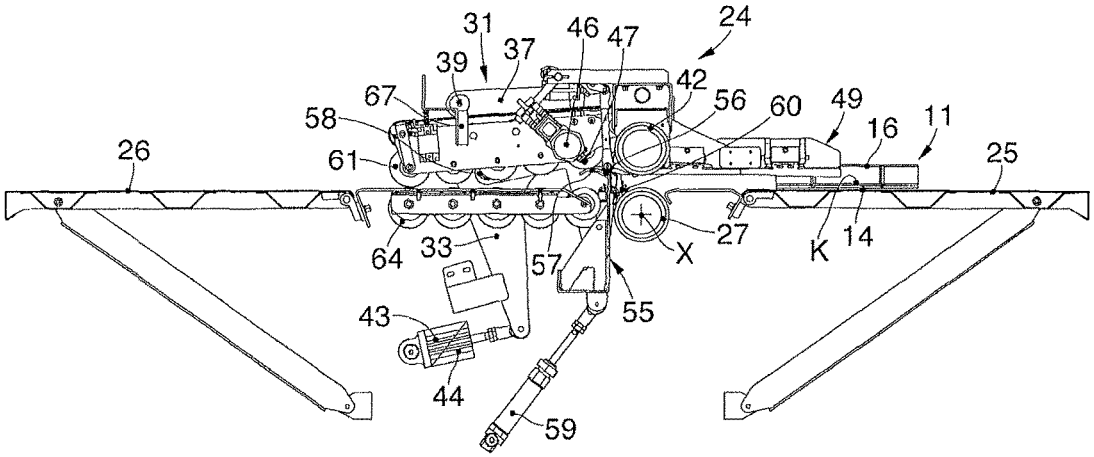
FIG. 11 is a partial sectioned view along the line XI-XI of FIG. 10.

Two actuators 43 and 44, for example consisting of pneumatic pistons, are mounted on the fixed frame 21 and are connected to the lower arms of the two levers 32 and 33. The two actuators 43 and 44 can be selectively actuated together to make the levers 32 and 33 oscillate with respect to their fixed pins 34 and 35, and thus move the presser roll 42 between an inactive position, raised and distant, for example 20 mm, from the feed roll 27 below (FIG. 11), and an operating position, lowered and near the feed roll 27 (FIG. 13), or in contact with this, and vice versa.

The presser roll 42 is made to rotate by the feed roll 27, by a group of four gears 45 (FIG. 7) always engaged with each other. The gears 45 are configured so as to guarantee a constant connection between the feed roll 27 and the presser roll 42 in any position whatsoever of the mobile frame 31.

A gluing device 46 (FIG. 11) of the known type is also mounted on the mobile frame 31, in an intermediate position between the two vertical sides 22 and 23 of the fixed frame 21. The gluing device 46 comprises a nozzle 47, suitable to selectively spray a suitable quick-setting glue, for example heated EVA, and is connected to a tank 48 of the glue (FIG. 4) disposed in the lower part of the fixed frame 21.

Advantageously, the position of the presser roll 42 in the lowered position of the mobile frame 31 can define a correct positioning of the gluing device 46, depending on the thickness of the sheet 11.

A first reference member 49 is also disposed on the mobile frame 31, aligned with the gluing device 46 along a transverse axis Y (FIG. 5) perpendicular to the longitudinal axis X of the feed roll 27.

Figure 10:
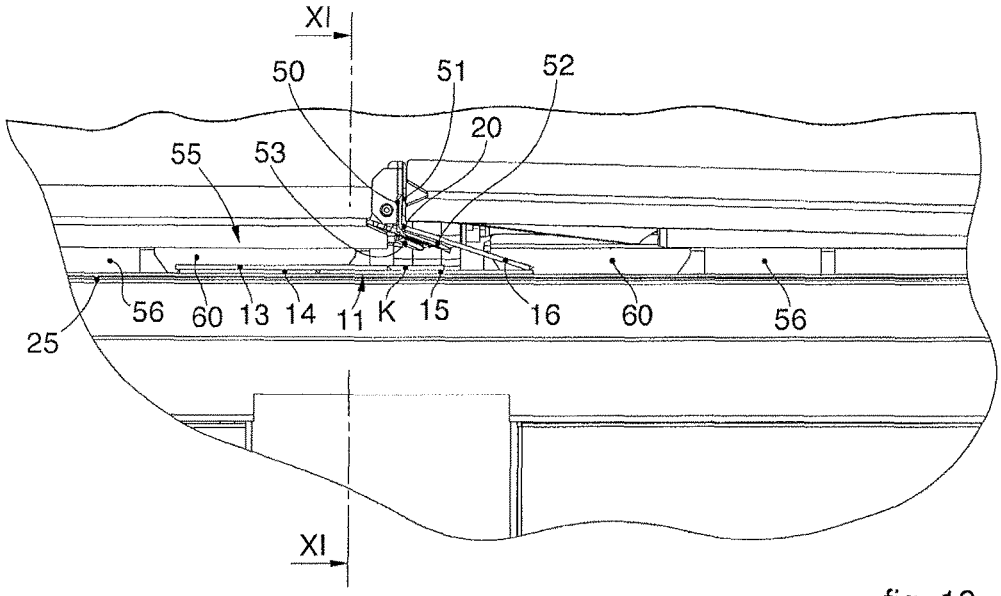
FIG. 10 is an enlarged detail of FIG. 4, showing in a first working step the pre-cut sheet of FIG. 3, folded to be able to glue one of its fins on a corresponding adjacent wall.

The first reference member 49 comprises a vertical wall 50, with a lateral surface 51 (on the right in FIGS. 9 and 10) which has the function of a reference element to correctly position the sheet 11 to be glued, in a determinate position with respect to the vertical sides 22 and 23 of the fixed frame 21, on the first support plane 25, as will be described in detail hereafter. The first reference member 49 also comprises a platen 52 inclined downward by about 17° with respect to the first support plane 25 (FIG. 10). The lateral wall 16 of the sheet 11 is suitable to rest on the platen 52.

A first sensor 53 is associated to the first reference member 49; it is the tactile or contact type which has the function of detecting the presence of the sheet 11 and the fin K below it, and to send a corresponding electric signal to a central control unit 54 mounted in the fixed frame 21. In particular, the lower end of the sensor 53 is associated to a motion multiplier mechanism, not shown in the drawings, so that the sensor 53 itself is able to send said electric signal even when it detects a minimum variation in thickness of the sheet 11, for example 1 mm.

Between the feed roll 27 and the second support plane 26 (FIG. 11) a second reference member 55 is disposed, which comprises a vertical barrier 56, parallel to the longitudinal axis X of the feed roll 27 and therefore perpendicular to the vertical wall 50 of the first reference member 49.

The vertical barrier 56 acts as an abutment plane and in an inactive position is raised (FIGS. 11, 12 and 13), so as to temporarily close the passage between the first support plane 25 and the second support plane 26, through the gap formed between the feed roll 27 and the presser roll 42 in the inactive position.

The vertical barrier 56 is selectively mobile between its inactive position and an operating position, in which it is lowered (FIGS. 14 to 17), and vice versa. In particular the vertical barrier 56 is attached to a pair of levers 57 (of which only one can be seen in the drawings), parallel to each other and pivoted on pins 58 of the fixed frame 21. The vertical barrier 56 is selectively moved by an actuator 59, for example consisting of a pneumatic piston mounted on the fixed frame 21, commanded by the central control unit 54.

At least two second sensors 60 (FIGS. 10 and 11) are mounted on the vertical barrier 56, facing first support plane 25 and disposed one on one side and one on the other side of the first reference member 49. The second sensors 60 are also the tactile or contact type, and have the function of detecting the presence of the edges of the upper fins 18 of the sheet 11 and of generating a corresponding electric signal to send to the central control unit 54. In particular, it is only by actuating both the second sensors 60 that the corresponding electric signal is generated. This happens when the upper fins 18 of the sheet 11 are correctly positioned against the vertical barrier 56. In this way the vertical barrier 56 and the second sensors 60 allow to easily and correctly position the sheet 11 with respect to the feed roll 27, with the fin K perpendicular to the longitudinal axis X.

Moreover, on the mobile frame 31, in a rear position with respect to the gluing device 46, a group of five upper rolls 61 is mounted (FIG. 8), aligned along the transverse axis Y and rotating together with the presser roll 42. In particular, the axes of rotation of the five upper rolls 61 lie substantially on a single plane that is inclined downward from the gluing device 46 toward the second support plane 26.

The five upper rolls 61 are made to rotate by a single transmission belt 62 that takes motion from a pulley 63 with a toothed pinion engaged with a corresponding toothed wheel (not visible in the drawings) integrated with the presser roll 42.

Five corresponding lower rolls 64 are mounted, freely rotatable, on the fixed frame 21, below the upper rolls 61, and are tangent to the horizontal plane on which the surfaces of the two support planes 25 and 26 lie.

The upper rolls 61 are provided to guide the sheet 11 and press it in proximity to the second support plane 26, to make the wall 16 of the sheet 11 adhere to the fin K below, immediately after the glue has been injected onto the latter by the nozzle 47. The upper rolls 61 also have the function of feeding the sheet selectively in the two directions of movement, that is, forward from the feed roll 27 toward the second support plane 26 or backward from the second support plane 26 toward the feed roll 27.

Another two groups of lower rolls 65 and 66 (FIG. 5) are disposed, parallel to the transverse axis Y, one on one side and one on the other side of the gluing device 46, to facilitate the movement of the sheet 11 with respect to the operating unit 24.

In correspondence to the upper rolls 61 a third sensor 67 is disposed, of the optical type for example, such as a photocell, which is suitable to detect the complete passage of the sheet 11 downstream of the gluing device 46 and to generate a corresponding electric signal to be transmitted to the central control unit 54.

The gluing machine 10 as described heretofore functions as follows.

In the inactive position (FIGS. 1 and 4 to 8) the gluing machine 10 has the mobile frame 31 in a raised position, so that the presser roll 42 is distant from the feed roll 27 and the first reference member 49 is raised from the first support plane 25. The vertical barrier 56 is also in the raised position.

In a first working step, which for example can be carried out manually by an operator, a sheet 11 to be glued is positioned on the first support plane 25 (FIGS. 10 and 11), so that its lateral walls 14 and 15 rest on the first support plane 25 (FIG. 10), its lateral wall 13 is folded above the lateral wall 14 and the lateral wall 16 is folded with respect to the lateral wall 15 but rests on the platen 52. In this way the fin K is positioned below the platen 52.

The edge 20 of the lateral wall 16 is then thrust against the surface 51 of the first reference member 49. A precise alignment of the sheet 11 with respect to the vertical sides 22 and 23 of the fixed frame 21 is thus obtained, on the first support plane 25.

Figure 12:
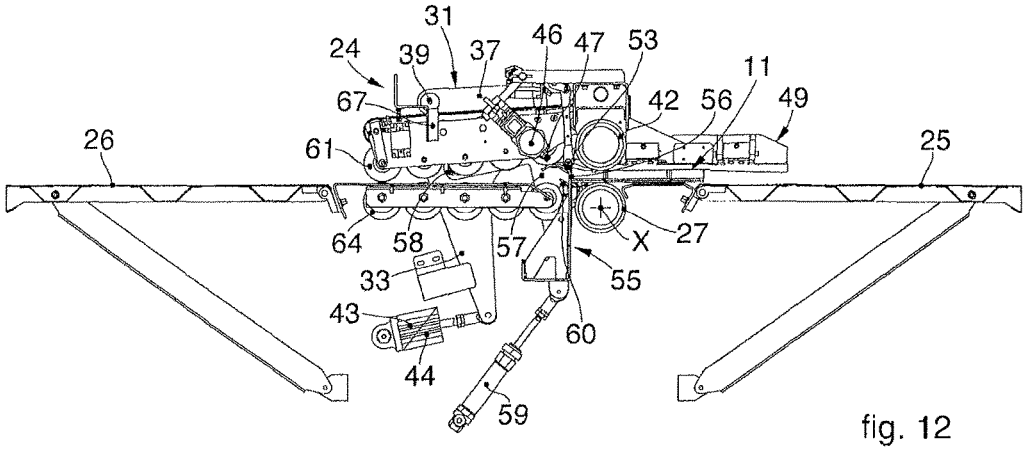
FIG. 12 is similar to the view of FIG. 10, but shows a second working step of the gluing machine of FIG. 1.

In a second working step, which for example can also be carried out manually by an operator, the sheet 11 is thrust forward, until its upper fins 18 are taken into contact with the vertical barrier 56 (FIG. 12) and both the second sensors 60 are actuated (FIGS. 10 and 12). This actuation is indicative of the fact that the sheet 11 is positioned with precision also with respect to the longitudinal axis X. Consequently the fin K will be parallel to the transverse axis Y.

With the actuation of the at least two second sensors 60, the central control unit 54 begins to generate, in a programmed manner, a sequence of commands that determine the automatic gluing of the lateral wall 16 of the sheet 11, in correspondence to its edge 20, on the fin K below.

Indeed, while the first two working steps described above can normally be carried out manually by an operator, the subsequent working steps are carried out completely automatically.

Figure 13:
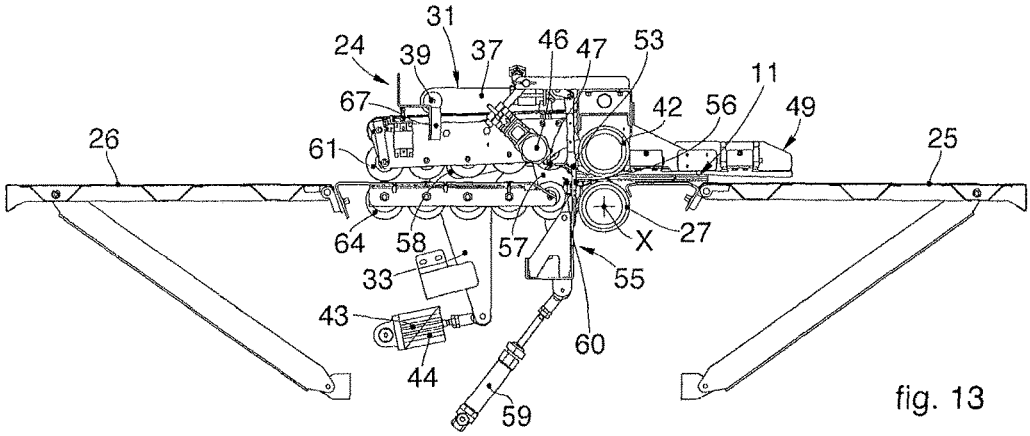
FIG. 13 is similar to the view of FIG. 10, but shows a third working step of the gluing machine of FIG. 1.

In a third working step, shown schematically in FIG. 13, the central control unit 54 commands the activation of the two actuators 43 and 44, so that the mobile frame 31 is taken into its lowered position, with the presser roll 42 going to press the sheet 11 against the feed roll 27 below. In this position the first sensor 53 detects the presence of one of the two upper fins 18 of the sheet 11, but not yet that of the fin K, which is in a position behind. Since the position of the first sensor 53, with respect to the first support plane 25, depends on the thickness of the sheet 11, which can be comprised between a minimum, for example 1 mm, and a maximum, for example 10 mm, the central control unit 54 assumes this position of the first sensor 53 as its reference position or zero position.

Figure 14:
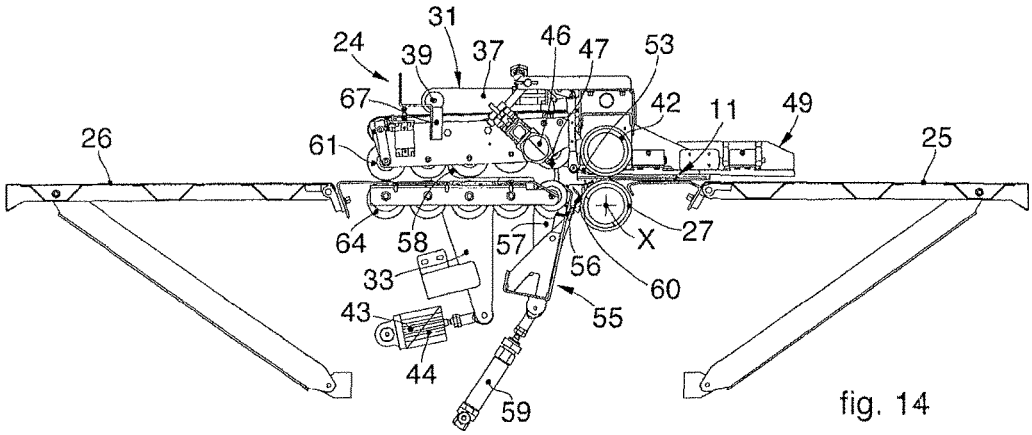
FIG. 14 is similar to the view of FIG. 10, but shows a fourth working step of the gluing machine of FIG. 1.

In a fourth working step, shown schematically in FIG. 14, the central control unit 54 commands the activation of the actuator 59, which lowers the vertical barrier 56. With the vertical barrier 56 lowered the electric motor 29 is powered so that the feed roll 27 and the presser roll 42, rotating one in one direction (anti-clockwise in FIG. 14) and the other in the opposite direction, cause the sheet 11 to be fed toward the gluing device 46.

Figure 15:
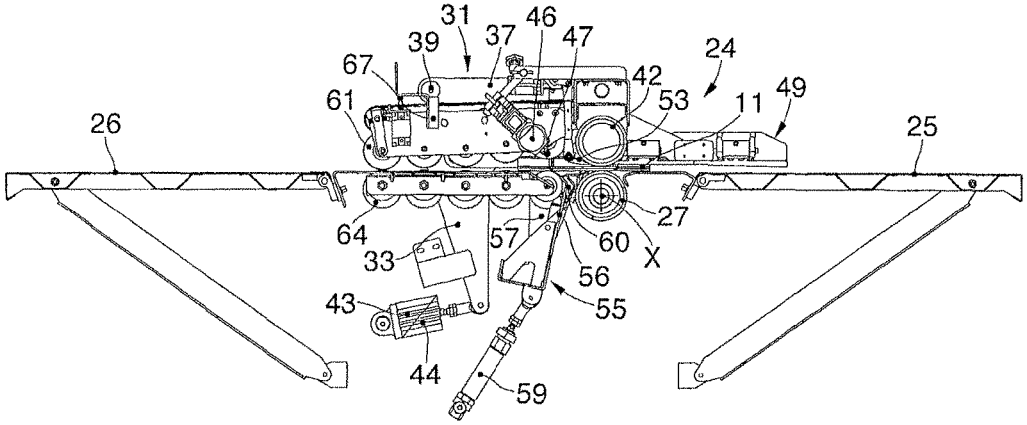
FIG. 15 is similar to the view of FIG. 10, but shows a fifth working step of the gluing machine of FIG. 1.

In a fifth working step, shown schematically in FIG. 15, when the first sensor 53 detects the presence of the fin K, the central control unit 54 activates the gluing device 46 and deactivates it when the first sensor 53 detects that the fin K has passed. The actual activation and deactivation of the gluing device 46 occurs with a programmed delay, depending both on the distance between the first sensor 53 and the nozzle 47, and also on the speed of movement of the sheet 11. In this fifth working step the lateral wall 16 of the sheet 11 leaves the platen 52 and is guided downward by the upper rolls 51 to bring it into contact with the fin K below.

Figure 16:
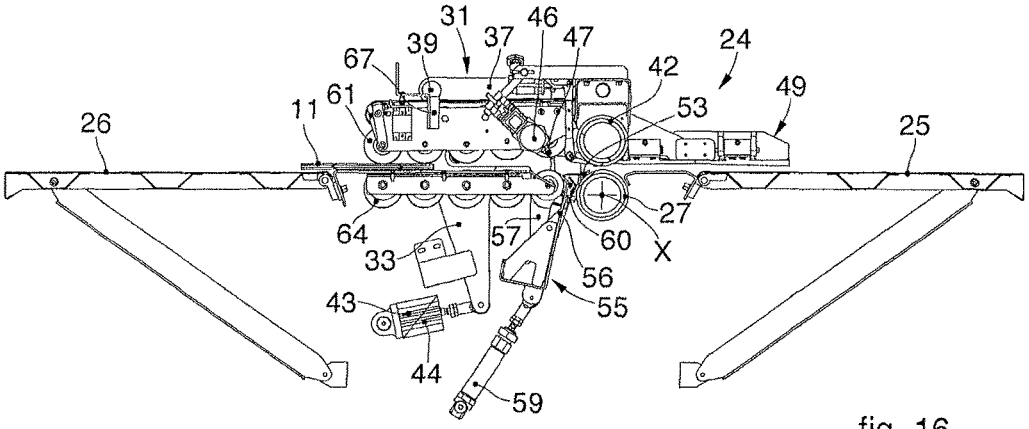
FIG. 16 is similar to the view of FIG. 10, but shows a sixth working step of the gluing machine of FIG. 1.

In a sixth working step, shown schematically in FIG. 16, by means of the third sensor 67 that detects the complete passage of the sheet 11 below it, the central control unit 54 commands the electric motor 29 so that the most external of the rolls 61 completes the pressure action of the lateral wall 16 of the sheet 11 against the fin K below, on which the glue has been applied.

Figure 17:
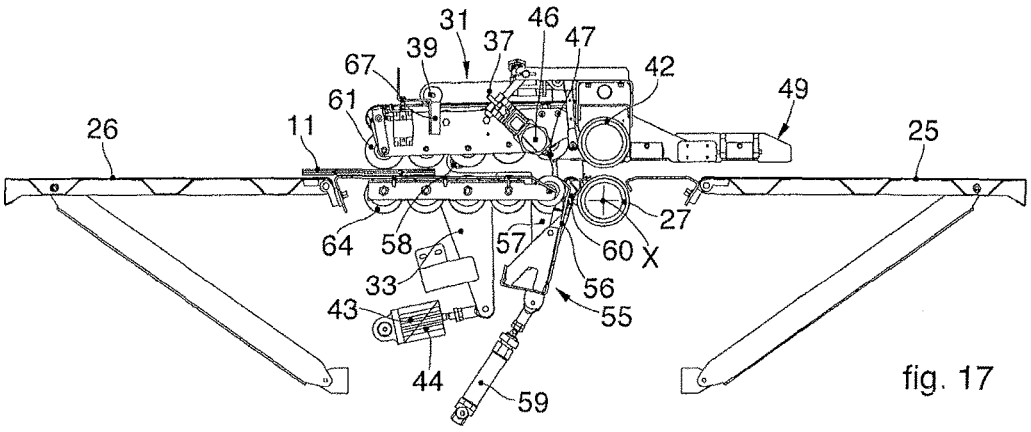
FIG. 17 is similar to the view of FIG. 10, but shows a seventh working step of the gluing machine of FIG. 1.

In a seventh and last working step, shown schematically in FIG. 17, as a function of the production needs, the central control unit 54 causes the expulsion of the sheet 11, already glued, toward the second support plane 26, or backward toward the first support plane 25, inverting the direction of rotation of the electric motor 19 and therefore of the rolls 27, 28 and 61 commanded by it.

It is clear that modifications and/or additions of parts may be made to the gluing machine 10 and to the related method as described heretofore, without departing from the field and scope of the present invention.

For example, the gluing device could spread the glue on a lower zone of the lateral wall 16, in correspondence to the fin K, in order to obtain in any case the gluing of the latter and the corresponding lower zone of the lateral wall 16.

It is also clear that, although the present invention has been described with reference to some specific examples, a person of skill in the art shall certainly be able to achieve many other equivalent forms of gluing machine having the characteristics as set forth in the claims and hence all coming within the field of protection defined thereby.

The invention claimed is:

1. A gluing machine (10) for making a box (12) starting from a pre-cut sheet (11) that includes at least lateral walls (13, 14, 15, 16) of said box (12) to be made, and a joining fin (K) between two of said lateral walls (13, 16) that are adjacent to each other, said gluing machine (10) comprising:

a fixed frame (21) having at least a first support plane (25) to support said sheet (11) when fed into said gluing machine;

a first reference member (49) to align said sheet (11) laterally over said first support plane (25); a gluing device (46) positioned downstream of said first reference member to spread a gluing material on said fin (K), or on one of said lateral walls (16) to be coupled to said fin, wherein said gluing device (46) and said first reference member (49) are supported by a same support member (31) that is mounted on said fixed frame (21) and is mobile with respect to said fixed frame (21) between an inactive position and an operating position, said gluing device (46) being positioned on said support member (31) downstream of said first reference member (49);

feeding means mounted on said frame to advance said sheet in a feeding direction, said feeding means being rigid and comprising a feed roll (27) mounted on said fixed frame (21) and rotatable around an own longitudinal axis (X) perpendicular to said feeding direction and parallel to said first support plane (25); and a presser roll (42) mounted rotatable on said support member (31) and parallel to said feed roll (27), wherein a first sensor (53) is associated to said first reference member (49), said first sensor (53) being a tactile or contact sensor and being adapted to detect a presence of the sheet (11) and of the fin (K) below said first sensor and a thickness of the sheet (11) and to send a corresponding electric signal to a central control unit (54) for activating the gluing device (46), and for deactivating the gluing device (46) when the fin (K) has passed.

2. The gluing machine as in claim 1, wherein said gluing device (46) and said first reference member (49) are disposed in an intermediate zone between two sides (22, 23) of said fixed frame (21) and are aligned along a transverse axis (Y) perpendicular to said longitudinal axis (X).

3. The gluing machine as in claim 2, wherein, in said inactive position of said support member (31), said presser roll (42) is distanced from said feed roll (27) to allow a free passage of said sheet (11) between said feed and presser rolls (27, 42), and wherein, in said operating position of said support member (31), said presser roll (42) is disposed to press said sheet (11) against said feed roll (27).

4. The gluing machine as in claim 2, further comprising a drive member (29) that selectively makes said feed roll (27) rotate, wherein said presser roll (42) is made to rotate by said feed roll (27) by a coupling providing a connection between said feed roll (27) and said presser roll (42) in any position of said support member (31).

5. The gluing machine as claim 1, wherein said first reference member (49) comprises a vertical wall (50), having a lateral surface (51), which functions as a reference element, and a support element (52) that holds temporarily raised the one of the lateral walls (16) of said sheet (11) to be glued to said fin (K).

6. The gluing machine as in claim 5, wherein said support element comprises a platen (52) inclined downward with respect to said first support plane (25), under which said fin (K) is set to be positioned.

7. The gluing machine as in claim 1, further comprising a second reference member (55) provided in proximity of said first reference member (49), said second reference member (55) aligning said sheet (11) frontally with respect to said first support plane (25), wherein said second reference member (55) comprises a vertical barrier (56) mobile between a first raised position, which interferes with a passage of said sheet (11) from said first support plane (25) toward said gluing device (46), and a lowered position, which allows a free passage of said sheet (11) from said first support plane (25) toward said gluing device (46).

8. The gluing machine as in claim 7, wherein at least two second sensors (60) are mounted on said vertical barrier (56), one on one side and one on another side with respect to said first reference member (49).

9. A gluing method of making a box (12) with a gluing machine (10) starting from a pre-cut sheet (11) that includes at least lateral walls (13, 14, 15, 16) of said box (12) to be made, and a joining fin (K) between two of said lateral walls (13, 16) that are adjacent to each other, comprising:

providing said gluing machine (10) with a fixed frame (21) having at least a first support plane (25) to support said sheet (11), a first reference member (49) to align said sheet (11) laterally with respect to said first support plane (25), a gluing device (46) to spread a gluing material on said fin (K), or on one of said lateral walls (16) to be coupled with said fin, and a first sensor (53) associated to said first reference member (49), said first sensor (53) being a tactile or contact sensor;

performing a preparation step, in which said gluing device (46) and said first reference member (49) are installed on a same support member (31) that is mounted on said fixed frame (21) and is mobile with respect to said fixed frame between an inactive position and an operating position, said gluing device (46) being positioned on said support member (31) downstream of said first reference member (49), and in which a feed roll (27) is mounted on said fixed frame (21) and is rotatable around a longitudinal axis (X) of said feed roll, parallel to said first support plane (25), wherein a presser roll (42) is mounted rotatable on said support member (31), parallel to said feed roll (27);

performing a first working step, in which said sheet (11) to be glued is positioned on said first support plane (25), so that a first and a second lateral wall (14 and 15) of said sheet are rested on said first support plane (25), in which a third lateral wall (13) is folded above said second lateral wall (14), and in which a fourth lateral wall (16) is folded with respect to said second lateral wall (15) but rests on said first reference member (49) so that said fin (K) is positioned under said first reference member (49) and aligned with said gluing device (46); and causing said first sensor (53) to detect a presence of the sheet (11) and of the fin (K) below said first sensor and a thickness of the sheet (11) and to send a corresponding electric signal to a central control unit (54) for activating the gluing device (46), and for deactivating the gluing device (46) when the fin (K) has passed.

10. The gluing method as in claim 9, further comprising at least a second working step, in which said sheet (11) is thrusted forward until an edge of said sheet, perpendicular to said fin (K), is taken into contact with at least two sensors (60) disposed one on one side and one on another side with respect to said first reference member (49), actuation of both said at least two sensors (60) causing a subsequent working steps in which automatic gluing of said fin (K) to said fourth lateral wall (16) is performed under a programmed control of a central control unit (54).

11. The gluing machine as in claim 1, wherein said fixed frame (21) supports an operating unit (24) having said feed roll (27) in a lower portion and said support member (31) and in an upper portion, and wherein said presser roll (42) defines a correct positioning of the gluing device (46) depending on a thickness of the sheet (11) when the support member (31) is in the operating position.

* * * * *